US010612308B2

(12) United States Patent
Drenth et al.

(10) Patent No.: US 10,612,308 B2
(45) **Date of Patent: *Apr. 7, 2020**

(54) CORE LIFTER

(71) Applicant: BLY IP INC., Salt Lake City, UT (US)

(72) Inventors: Christopher L. Drenth, Burlington (CA); Hongyan Zhang, Wuxi (CN)

(73) Assignee: BLY IP INC., Salt Lake City, UT (US)

( * ) Notice: Subject to any disclaimer, the term of this patent is extended or adjusted under 35 U.S.C. 154(b) by 321 days.

This patent is subject to a terminal disclaimer.

(21) Appl. No.: 15/628,133

(22) Filed: Jun. 20, 2017

(65) Prior Publication Data

US 2017/0284160 A1 Oct. 5, 2017

Related U.S. Application Data

(63) Continuation of application No. 14/326,217, filed on Jul. 8, 2014, now abandoned, which is a continuation of application No. 12/917,774, filed on Nov. 2, 2010, now Pat. No. 8,770,320.

(60) Provisional application No. 61/257,599, filed on Nov. 3, 2009.

(51) Int. Cl.

| | |
|---|---|
| ***E21B 10/02*** | (2006.01) |
| ***E21B 25/12*** | (2006.01) |
| ***E21B 25/00*** | (2006.01) |
| ***E21B 25/10*** | (2006.01) |

(52) U.S. Cl.

CPC ..... *E21B 10/02* (2013.01); *E21B 25/00* (2013.01); *E21B 25/10* (2013.01); *E21B 25/12* (2013.01); *Y10T 29/49826* (2015.01)

(58) Field of Classification Search

CPC ..... E21B 10/02; E21B 25/10; E21B 25/00; E21B 25/12; Y10T 29/49826

See application file for complete search history.

(56) References Cited

U.S. PATENT DOCUMENTS

| | | | |
|---|---|---|---|
| 1,378,442 | A | 5/1921 | Chalfant |
| 1,612,461 | A | 12/1926 | Mitchell |
| 1,791,256 | A | 2/1931 | Wellensiek |

(Continued)

FOREIGN PATENT DOCUMENTS

| | | | |
|---|---|---|---|
| AU | 134164 | S | 6/1998 |
| AU | 2008314656 | A1 | 5/2009 |

(Continued)

OTHER PUBLICATIONS

U.S. Appl. No. 61/257,599, filed Nov. 3, 2009, Chritopher L. Drenth.

(Continued)

*Primary Examiner* — Brad Harcourt
(74) *Attorney, Agent, or Firm* — Ballard Spahr LLP

(57) ABSTRACT

A core lifter and method for making same for use in a drilling system. The core lifter can include a tubular body having an exterior surface and an interior surface and can have a plurality of longitudinally-oriented recesses formed in the exterior surface of the tubular body of the core lifter and extending radially inwardly relative to the central axis of the core lifter. The plurality of longitudinally-oriented recesses formed in the exterior surface of the tubular body of the core lifter can extend along at least 50 percent of the length of the core lifter.

15 Claims, 12 Drawing Sheets

(56) References Cited

U.S. PATENT DOCUMENTS

| | | | | |
|---|---|---|---|---|
| D93,650 | S | 10/1934 | Fleisch | |
| D95,675 | S | 5/1935 | Fuerst | |
| 2,022,640 | A | 11/1935 | Ullmann | |
| 2,205,598 | A | 6/1940 | Miller | |
| D138,312 | S | 7/1944 | Derham | |
| D198,953 | S | 8/1964 | Quintal | |
| 3,328,068 | A | 6/1967 | Robinson | |
| 3,340,939 | A | 9/1967 | Lindelof | |
| D209,933 | S | 1/1968 | Wilson | |
| 3,428,138 | A | 2/1969 | Casper et al. | |
| 3,540,537 | A | 11/1970 | Brown | |
| 3,661,289 | A | 5/1972 | Segmuller | |
| 3,924,772 | A | 12/1975 | Magnani et al. | |
| D268,650 | S | 4/1983 | Kirstine | |
| 4,470,290 | A | 9/1984 | Jungesjo | |
| 4,651,835 | A | 3/1987 | Davis | |
| D291,868 | S | 9/1987 | Hindle | |
| 4,883,131 | A | 11/1989 | Foster | |
| D309,863 | S | 8/1990 | Baxter | |
| 5,146,999 | A | 9/1992 | Wiser et al. | |
| 5,341,466 | A | 8/1994 | Perlin et al. | |
| D351,795 | S | 10/1994 | Ogden | |
| D354,914 | S | 1/1995 | Newman | |
| 6,378,631 | B1 | 4/2002 | Aumann et al. | |
| 6,394,196 | B1 | 5/2002 | Fanuel et al. | |
| D458,138 | S | 6/2002 | Fuchs | |
| D465,731 | S | 11/2002 | Brant et al. | |
| D467,803 | S | 12/2002 | Brown et al. | |
| D477,224 | S | 7/2003 | Hussain | |
| D482,967 | S | 12/2003 | Bourque et al. | |
| D487,700 | S | 3/2004 | Bourque et al. | |
| D529,804 | S | 10/2006 | Lohrman | |
| D542,655 | S | 5/2007 | Szczesniak | |
| D542,656 | S | 5/2007 | Szczesniak | |
| D568,450 | S | 5/2008 | King, Jr. et al. | |
| D606,401 | S | 12/2009 | Kamath et al. | |
| D620,959 | S | 8/2010 | Drenth et al. | |
| D625,346 | S | 10/2010 | Drenth et al. | |
| D644,673 | S | 9/2011 | Drenth et al. | |
| 8,770,320 | B2 * | 7/2014 | Drenth | E21B 25/12 175/244 |
| 2003/0168870 | A1 | 9/2003 | Spencer et al. | |
| 2009/0047083 | A1 | 2/2009 | Perry | |
| 2011/0079436 | A1 | 4/2011 | Drenth et al. | |
| 2011/0100718 | A1 | 5/2011 | Drenth et al. | |
| 2014/0318206 | A1 | 10/2014 | Drenth et al. | |

FOREIGN PATENT DOCUMENTS

| | | | |
|---|---|---|---|
| AU | 331143 | S | 6/2010 |
| AU | 2010315341 | | 11/2010 |
| AU | 2010315341 | A1 | 5/2012 |
| AU | 2015200880 | | 2/2015 |
| AU | 2017203716 | | 6/2017 |
| BR | 1120120105159 | | 11/2010 |
| CA | 2779277 | | 11/2010 |
| CA | 2901059 | | 11/2010 |
| CA | 2901046 | | 8/2015 |
| CL | 2012-01168 | | 11/2010 |
| CN | 2053237 | U | 2/1990 |
| CN | 2690572 | Y | 4/2005 |
| CN | 2740766 | Y | 11/2005 |
| CN | 201080059480.9 | | 11/2010 |
| CN | 2015105723177 | | 11/2010 |
| EP | 10828992.7 | | 11/2010 |
| NZ | 599744 | | 11/2010 |
| PE | 0006042012 | | 11/2010 |
| WO | WO-1996/06698 | A1 | 3/1996 |
| WO | WO-00/06866 | A1 | 2/2000 |
| WO | PCT/US2010/055196 | | 11/2010 |
| WO | WO-2011/056809 | A2 | 5/2011 |
| ZA | 2012/04027 | | 11/2010 |

OTHER PUBLICATIONS

U.S. Appl. No. 12/917,774 (U.S. Pat. No. 8,770,320), filed Nov. 2, 2010 (Jul. 8, 2014), Chritopher L. Drenth.

U.S. Appl. No. 14/326,217, filed Jul. 8, 2014, Chritopher L. Drenth.

International Search Report and Written Opinion dated Jun. 7, 2011 by the International Searching Authority for International Application No. PCT/US2010/055196, filed on Nov. 3, 2010 and published as WO 2011/056809 on May 12, 2011 (Applicant—Longyear TM, Inc) (9 Pages).

International Preliminary Report on Patentability dated May 8, 2012 by the International Searching Authority for International Application No. PCT/US2010/055196, filed on Nov. 3, 2010 and published as WO 2011/056809 on May 12, 2011 (Applicant—Longyear TM, Inc) (7 Pages).

Examination Report dated Oct. 3, 2013 by the Australian Patent Office for AU Application No. 2010315341, filed on Nov. 3, 2010 and published as AU 2010315341 A1 on May 24, 2012(Applicant—Longyear TM, Inc.) (4 Pages).

Notice of Acceptance dated Nov. 6, 2014 by the Australian Patent Office for AU Application No. 2010315341, filed on Nov. 3, 2010 and published as AU 2010315341 A1 on May 24, 2012(Applicant—Longyear TM, Inc.) (2 Pages).

Examination Report dated Mar. 10, 2016 by the Australian Patent Office for AU Application No. 2015200880, filed on Feb. 20, 2015 and published as AU 2015200880 A1 on May 24, 2012 (Applicant—Longyear TM, Inc.) (6 Pages).

Notice of Acceptance dated Feb. 21, 2017 by the Australian Patent Office for AU Application No. 2015200880, filed on Feb. 20, 2015 and published as AU 2015200880 A1 on May 24, 2012 (Applicant—Longyear TM, Inc.) (3 Pages).

Examination Report dated Aug. 13, 2018 by the Australian Patent Office for AU Application No. 2017203716, filed on Feb. 20, 2015 and published as AU 2017203716 A1 on Jun. 22, 2017 (Applicant—BLY IP, Inc.) (5 Pages).

Notice of Acceptance dated Jul. 12, 2019 by the Australian Patent Office for AU Application No. 2017203716, filed on Feb. 20, 2015 and published as AU 2017203716 A1 on Jun. 22, 2017 (Applicant—BLY IP, Inc.) (3 Pages).

Partial European Search Report and Written Opinion dated Feb. 17, 2017 by the European Patent Office for EP Application No. 10828992.7, filed on Nov. 3, 2010 and published as EP 2496788 A2 on Sep. 12, 2012 (Applicant—Longyear TM, Inc.) (10 Pages).

European Search Report and Written Opinion dated May 26, 2017 by the European Patent Office for EP Application No. 10828992.7, filed on Nov. 3, 2010 and published as EP 2496788 A2 on Sep. 12, 2012 (Applicant—Longyear TM, Inc.) (9 Pages).

Office Action dated Sep. 6, 2013 by the Canadian Intellectual Property Office for Canadian Patent Application No. 2,779,277 and granted as 2,779,277 on Dec. 8, 2015 (Applicant—Longyear TM, Inc.) (2 pages).

Second Office Action dated May 13, 2014 by the Canadian Intellectual Property Office for Canadian Patent Application No. 2,779,277 and granted as 2,779,277 on Dec. 8, 2015 (Applicant—Longyear TM, Inc.) (2 pages).

Notice of Allowance dated Feb. 20, 2015 by the Canadian Intellectual Property Office for Canadian Patent No. 2,779,277 on Nov. 3, 2010 and granted as 2,779,277 on Dec. 8, 2015 (Applicant—Longyear TM, Inc.) (1 page).

Office Action dated Jul. 26, 2016 by the Canadian Intellectual Property Office for Canadian Patent Application No. 2,901,046 on Aug. 20, 2015 (Applicant—BLY IP, Inc) (3 pages).

Office Action dated May 17, 2017 by the Canadian Intellectual Property Office for Canadian Patent Application No. 2,901,046 on Aug. 20, 2015 (Applicant—BLY IP, Inc) (3 pages).

Notice of Allowance dated Jul. 22, 2016 by the Canadian Intellectual Property Office for Canadian Patent Application No. 2,901,059 on Nov. 30, 2010 and granted as 2901059 on Feb. 28, 2017 (Applicant—BLY IP, Inc.) (1 page).

Examination Report dated Feb. 26, 2014 by the Chilean Patent Office for Chilean Patent No. 2012-01168, which was filed Nov. 3, 2010 (Applicant—Longyear TM, Inc.) (6 pages).

(56) References Cited

OTHER PUBLICATIONS

First Office Action dated Feb. 12, 2014 by the SIPO for CN Patent Application No. 201080059480.9, which was filed Nov. 3, 2010 and published as CN 102686823 A on Sep. 19, 2012 (Applicant—Longyear TM, Inc.) (6 pages).
Second Office Action dated Sep. 12, 2014 by the SIPO for CN Patent Application No. 201080059480.9, which was filed Nov. 3, 2010 and published as CN 102686823 A on Sep. 19, 2012 (Applicant—Longyear TM, Inc.) (9 pages).
Third Office Action dated Feb. 10, 2015 by the SIPO for CN Patent Application No. 201080059480.9, which was filed Nov. 3, 2010 and published as CN 102686823 A on Sep. 19, 2012(Applicant—Longyear TM, Inc.) (6 pages).
Notification to Grant Patent Right for Invention dated Jun. 25, 2015 by the SIPO for CN Patent Application No. 201080059480.9, which was filed Nov. 3, 2010 (Applicant—Longyear TM, Inc.) (2 pages).
First Office Action dated May 2, 2017 by the SIPO for CN Patent Application No. 201510572317, which was filed Nov. 3, 2010 and Published as CN 105257230 A on Jan. 20, 2016 (Applicant—Longyear TM, Inc.) (9 pages).
Non-Final Rejection dated Feb. 13, 2013 by the USPTO for U.S. Appl. No. 12/917,774, filed Nov. 2, 2010 (Inventor—Drenth) (15 pages).
Response to Non-Final Rejection dated Jul. 15, 2013 to the USPTO for U.S. Appl. No. 12/917,774, filed Nov. 2, 2010 (Inventor—Drenth) (19 pages).
Final Rejection dated Sep. 25, 2013 by the USPTO for U.S. Appl. No. 12/917,774, filed Nov. 2, 2010 (Inventor—Drenth) (14 pages).
Response to Final Rejection and RCE dated Dec. 26, 2013 to the USPTO for U.S. Appl. No. 12/917,774, filed Nov. 2, 2010 (Inventor—Drenth) (17 pages).
Notice of Allowance dated Apr. 25, 2014 by the USPTO for U.S. Appl. No. 12/917,774, filed Nov. 2, 2010 (Inventor—Drenth) (5 pages).
Issue Notification dated Jun. 18, 2014 by the USPTO for U.S. Appl. No. 12/917,774, filed Nov. 2, 2010 (Inventor—Drenth) (1 page).
Non Final Rejection dated Mar. 24, 2017 by the USPTO for U.S. Appl. No. 14/326,217, filed Jul. 8, 2014 (Inventor—Drenth) (8 pages).
Notice of Abandonment dated Oct. 3, 2017 by the USPTO for U.S. Appl. No. 14/326,217, filed Jul. 8, 2014 (Inventor—Drenth) (2 pages).

* cited by examiner

CORE LIFTER

CROSS-REFERENCE TO RELATED APPLICATIONS

This application is a continuation of U.S. application Ser. No. 14/326,217, filed Jul. 8, 2014, which is a continuation of U.S. application Ser. No. 12/917,774, filed Nov. 2, 2010, which is now U.S. Pat. No. 8,770,320, issued Jul. 8, 2014, which claims priority to U.S. Provisional Application No. 61/257,599, filed Nov. 3, 2009. The disclosures of each of the above-referenced applications are hereby incorporated herein by reference in their entirety.

BACKGROUND

Field of the Invention

This application relates generally to drilling systems and methods.

Background Technology

Exploration drilling often includes retrieving a sample from a formation. The retrieved sample may then be evaluated to determine its contents.

In a wireline exploration drilling process, a drill string may be used to retrieve a sample from a formation. The drill string may comprise an open-faced drill bit, an outer tube of a core barrel assembly, and a series of connected drill rods, which may be assembled section-by-section as the drill bit and the core barrel assembly move deeper into the formation. The outer tube of the core barrel assembly may be connected to the drill bit and the series of drill rods. The core barrel assembly may also comprise an inner tube assembly, which may be releasably locked to the outer tube. With the inner tube assembly locked to the outer tube, the drill bit, the core barrel assembly and the drill rods may be rotated and/or pushed into the formation to allow a core sample to be collected within the inner tube assembly. After the core sample is collected, the inner tube assembly may be unlocked from the outer tube. The inner tube assembly may then be retrieved using a retrieval system, while portions of the drill string remain within the borehole. The core sample may be removed from the retrieved inner tube assembly, and after the core sample is removed, the inner tube assembly may be sent back and locked to the outer tube. With the inner tube assembly once again locked to the outer tube, the drill bit, the core barrel assembly and the drill rods may again be rotated and/or pushed further into the formation to allow another core sample to be collected within the inner tube assembly. Desirably, the inner tube assembly may be repeatedly retrieved and sent back in this manner to obtain several core samples, while portions of the drill string remain within the borehole. This may advantageously reduce the time necessary to obtain core samples because the drill string need not be tripped out of the borehole for each core sample.

The inner tube assembly may comprise a core lifter. The core lifter may be used to grip the core sample to facilitate its retrieval. Over time, the core lifter may wear down, which can cause damage that prevents it from gripping the core sample. This damage can prevent retrieval of the core sample.

SUMMARY

One aspect is a core lifter for use in a drilling system. The core lifter may comprise a tubular body including an exterior surface and an interior surface. The core lifter may also comprise a plurality of longitudinally-oriented recesses formed in the exterior surface of the tubular body of the core lifter.

Another aspect is a core lifter for use in a drilling system. The core lifter may comprise a tubular body including an exterior surface and an interior surface. The interior surface may comprise a gripping surface configured to grip a core sample. The cover lifter may also comprise a raised contact feature that extends inwardly away from the gripping surface.

Yet another aspect is a core lifter for use in a drilling system. The core lifter may comprise a tubular body and a flared skirt configured to limit movement of the core lifter relative to a core lifter case.

Still another aspect is a method of forming a core lifter for use in a drilling system. The method may comprise forming a tubular body of the core lifter by stamping a sheet of material.

For purposes of summarizing, some aspects, advantages and features of a few of the embodiments of the invention have been described in this summary. Some embodiments of the invention may comprise some or all of these summarized aspects, advantages and features. However, not necessarily all of (or any of) these summarized aspects, advantages or features will be embodied in any particular embodiment of the invention. Thus, none of these summarized aspects, advantages and features are essential. Some of these summarized aspects, advantages and features and other aspects, advantages and features may become more fully apparent from the following detailed description and the appended claims.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only illustrated embodiments of the invention and are therefore not to be considered limiting of its scope. The invention will be described and explained with additional specificity and detail through the use of the accompanying drawings in which.

DETAILED DESCRIPTION

Figure 1:
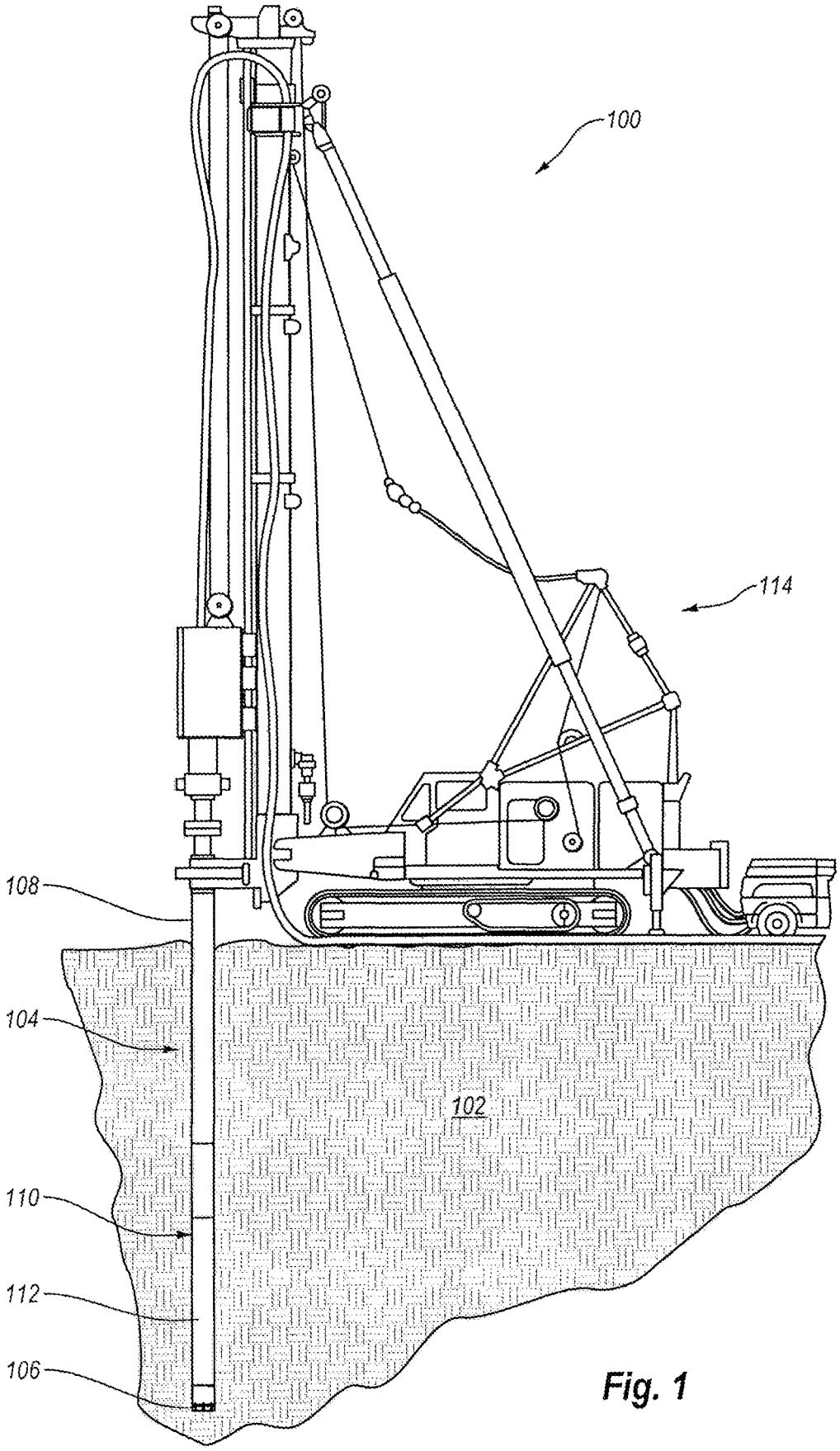
FIG. 1 illustrates an exemplary drilling system.

As shown in FIG. 1, a drilling system 100 may be used to retrieve a sample from a formation 102. The drilling system 100 may comprise a drill string 104 that may comprise a drill bit 106 (for example, an open-faced drill bit or other type of drill bit) and/or one or more drill rods 108.

The drilling system 100 may also comprise an in-hole assembly, such as a core barrel assembly 110, and the drill string 104 may comprise an outer portion of the in-hole assembly. For example, the drill string 104 may comprise an outer tube 112 of the core barrel assembly 110, which may be connected to the drill bit 106 and a set of one or more drill rods 108. In particular, the drill string 104 may comprise a reaming shell (which may interconnect the drill bit 106 and a leading portion of the outer tube 112) and an adapter coupling (which may interconnect a trailing portion of the outer tube 112 and the drill rods 108). It will be appreciated, however, that the outer tube 112 and/or other portions of the core barrel assembly 110 may be connected to the drill bit 106, the drill rods 108 and/or other portions of the drill string 104 using any other suitable components.

As part of a drilling process, the drill bit 106, the core barrel assembly 110, the drill rods 108 and/or other portions of the drill string 104 may be rotated and/or pushed into the formation 102 to form a borehole. During this process, a series of interconnected drill rods 108 may be assembled section-by-section.

The drilling system 100 may comprise a drill rig 114 that may rotate and/or push the drill bit 106, the core barrel assembly 110, the drill rods 108 and/or other portions of the drill string 104 into the formation 102. It will be appreciated, however, that the drilling system 100 does not require a drill rig and that the drilling system 100 may comprise other suitable components that may rotate and/or push the drill bit 106, the core barrel assembly 110, the drill rods 108 and/or other portions of the drill string 104 into the formation 102.

Figure 2:
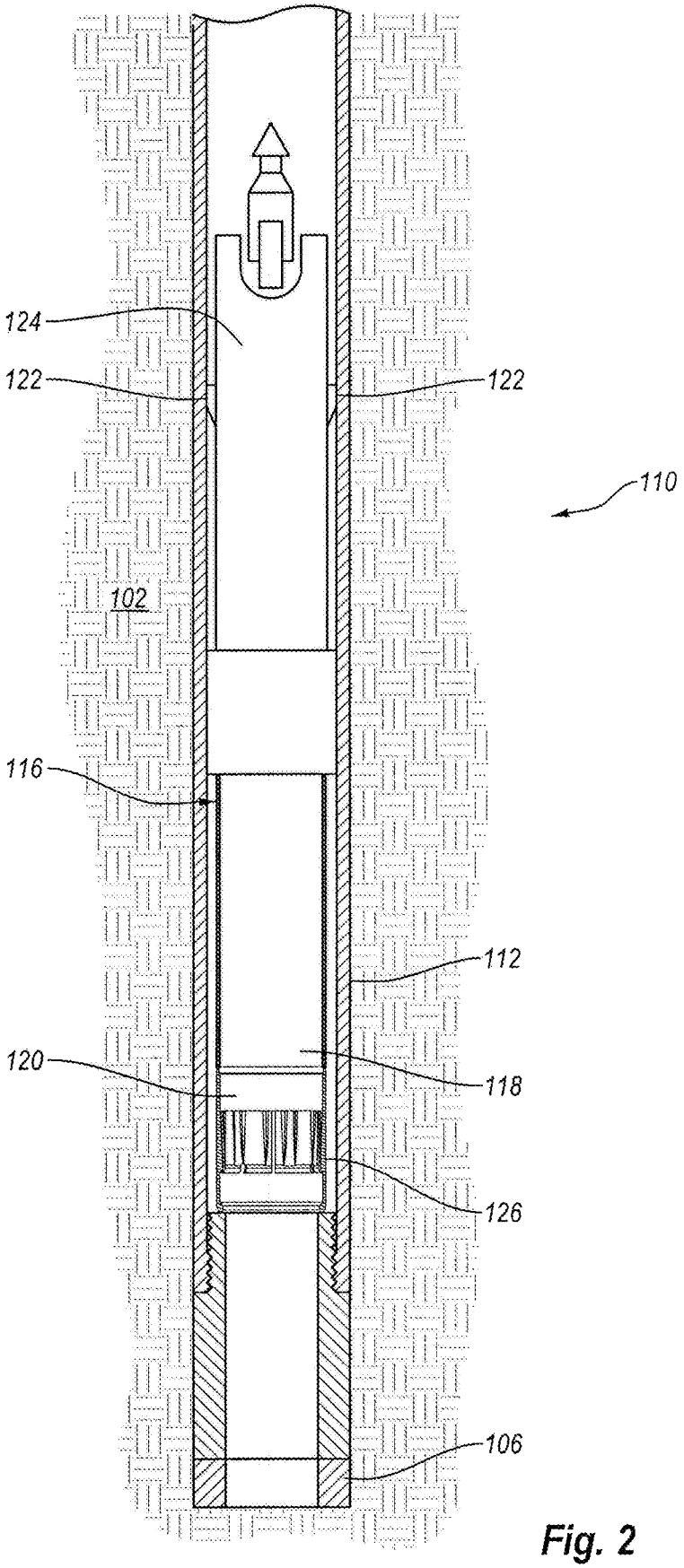
FIG. 2 illustrates a portion of the drilling system shown in FIG. 1.

As shown in FIG. 2, the core barrel assembly 110 may comprise an inner tube assembly 116, which may comprise one or more receptacles (such as an inner tube 118, a core lifter case 120 and/or other types of receptacles). The inner tube assembly 116 may be disposed within the drill string 104 and releasably locked to the outer tube 112 using, for example, one or more latches 122 or any other suitable means.

With the inner tube assembly 116 locked to the outer tube 112, the drill bit 106, the core barrel assembly 110, the drill rods 108 and/or other portions of the drill string 104 may be rotated and/or pushed into the formation 102 to allow a core sample to be collected within the one or more receptacles of the inner tube assembly 116. After the core sample is collected, the inner tube assembly 116 may be unlocked from the outer tube 112. The inner tube assembly 116 may then be retrieved, for instance using a wireline retrieval system, while the drill bit 106, the outer tube 112, one or more of the drill rods 108 and/or other portions of the drill string 104 remain within the borehole. The core sample may be removed from the retrieved inner tube assembly 116, and after the core sample is removed, the inner tube assembly 116 may be sent back and locked to the outer tube 112.

With the inner tube assembly 116 once again locked to the outer tube 112, the drill bit 106, the core barrel assembly 110, the drill rods 108 and/or other portions of the drill string 104 may be rotated and/or pushed further into the formation 102 to allow another core sample to be collected within the one or more receptacles of the inner tube assembly 116. Significantly, the inner tube assembly 116 may be repeatedly retrieved and sent back in this manner to obtain several core samples, while the drill bit 106, the outer tube 112, one or more of the drill rods 108 and/or other portions of the drill string 104 remain within the borehole. This may advantageously reduce the time necessary to obtain core samples because the drill string 104 need not be tripped out of the borehole for each core sample.

As indicated above, the inner tube assembly 116 may comprise one or more receptacles, such as the inner tube 118 and the core lifter case 120. As shown in FIG. 2, the inner tube assembly 116 may also comprise a head assembly 124 and a core lifter 126. A leading portion of the head assembly 124 may be connected to a trailing portion of the inner tube 118, and a leading portion of the inner tube 118 may be connected to a trailing portion of the core lifter case 120. In some embodiments, the inner tube 118 and the core lifter case 120 may form part of a unitary, one-piece structure, but this is not required.

Figure 3:
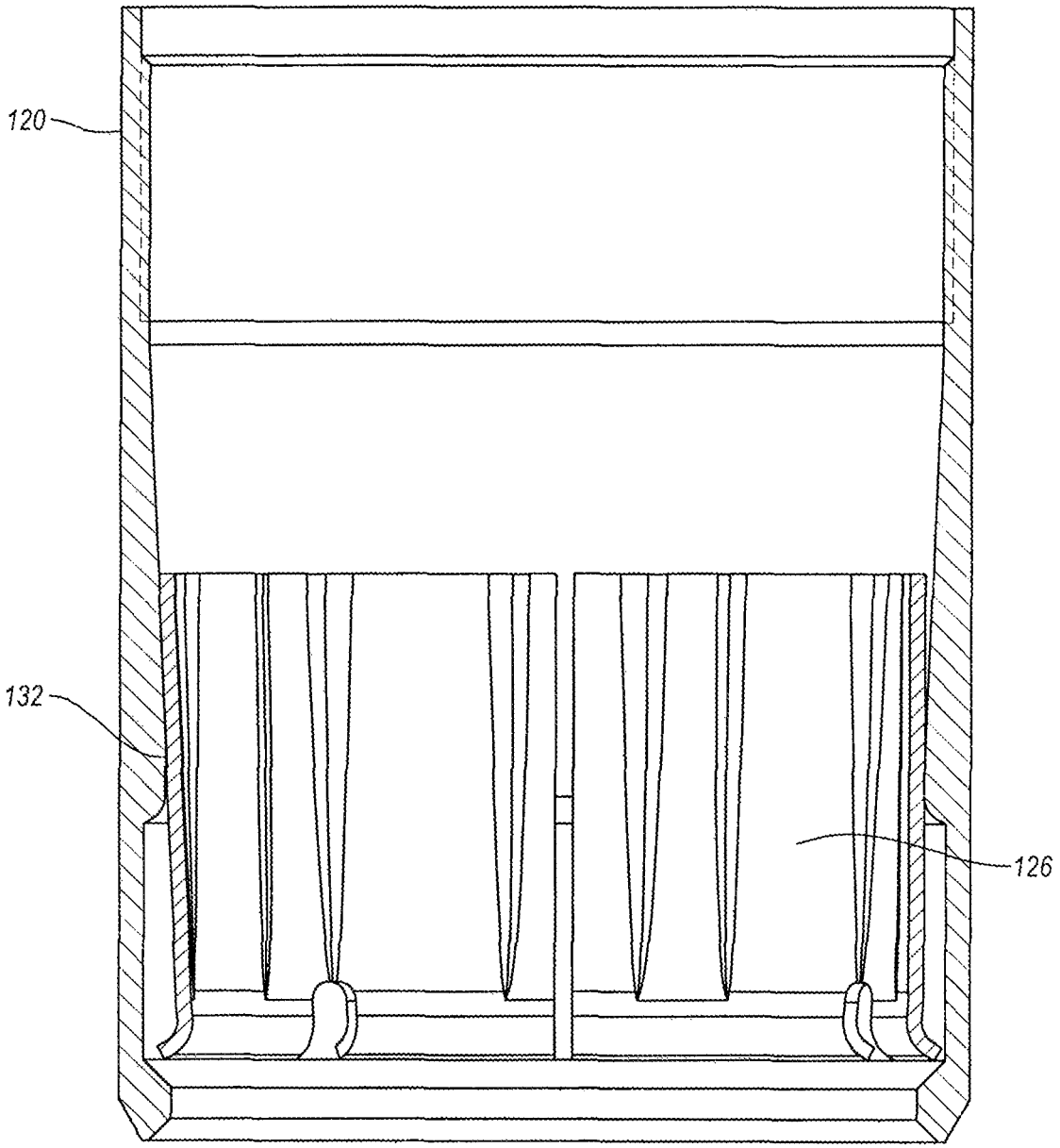
FIG. 3 is a cross-sectional view of a portion of the drilling system shown in FIG. 1, illustrating a core lifter and a core lifter case.
Figure 4:
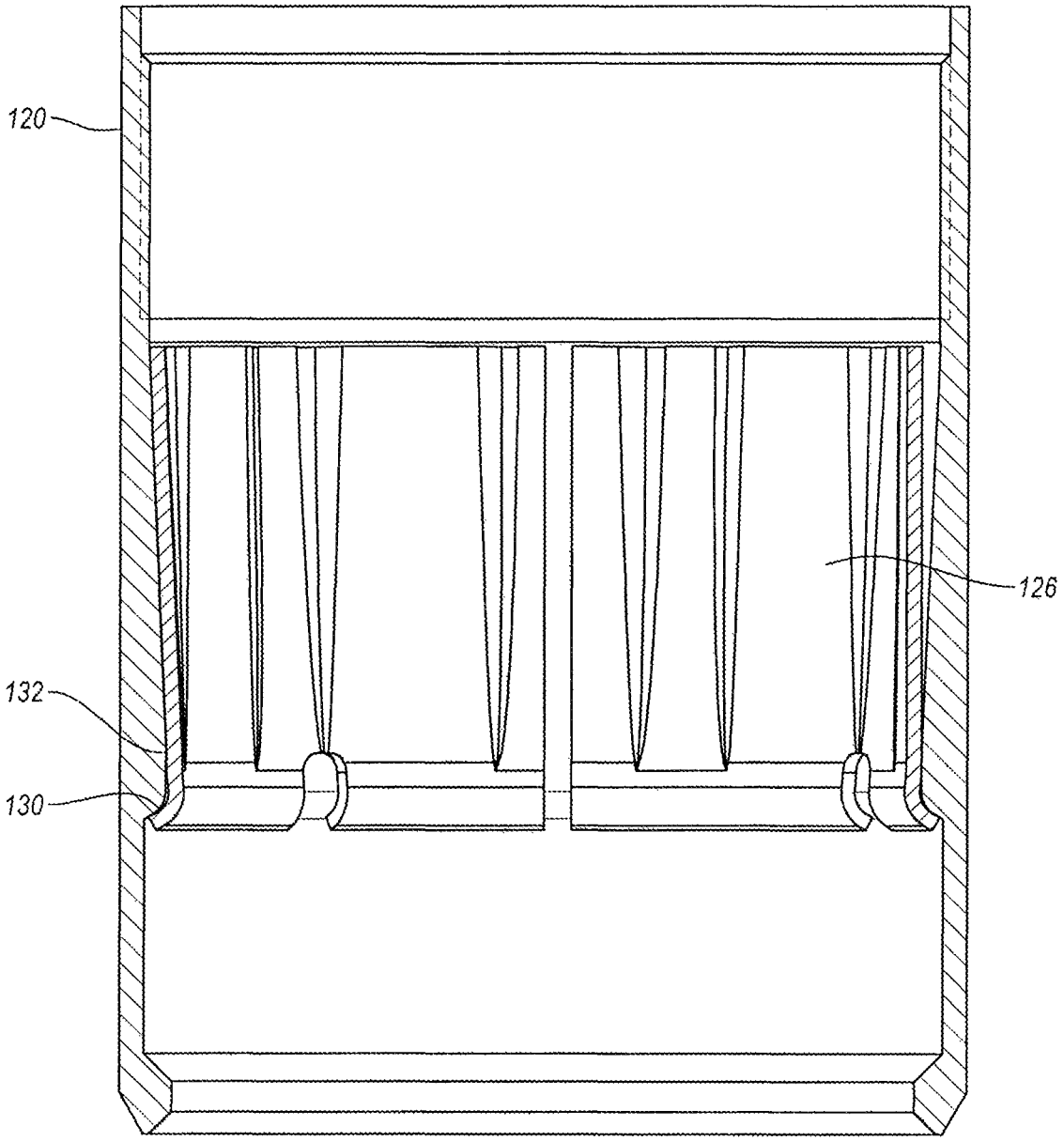
FIG. 4 is a cross-sectional view of the portion of the drilling system shown in FIG. 3, illustrating the core lifter and the core lifter case in another relative position.

The core lifter 126 may be disposed within the core lifter case 120. As shown in FIGS. 3 and 4, the core lifter 126 may be movable among a plurality of longitudinal positions within the core lifter case 120.

With the inner tube assembly 116 locked to the outer tube 112 and with the drill bit 106, the core barrel assembly 110, the drill rods 108 and/or other portions of the drill string 104 being rotated and/or pushed into the formation 102, the inner tube assembly 116 may collect a core sample. For example, one or more portions of a core sample 128 shown in FIG. 5 may enter the core lifter case 120, pass through the core lifter 126, exit the core lifter case 120, and enter the inner tube 118.

During this process, the core sample 128 may urge the core lifter 126 longitudinally within the core lifter case 120. For example, the core sample 128 may urge the core lifter 126 longitudinally towards the trailing portion of the core lifter case 120 (and away from the leading portion of the core lifter case 120) until the core lifter 126 contacts and/or abuts a stop, such as a shoulder 130 integrally formed in an interior of the core lifter case 120.

Figure 5:
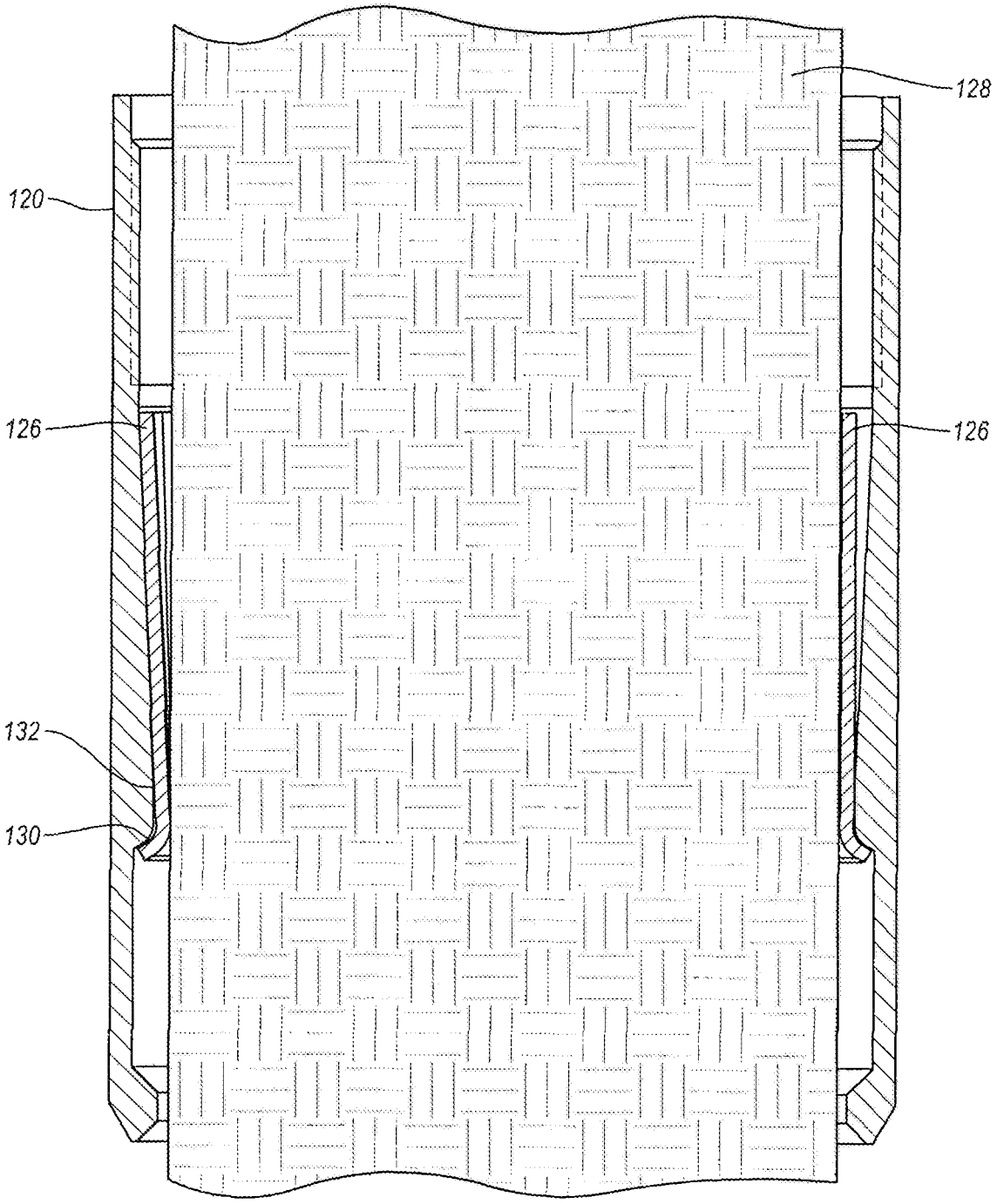
FIG. 5 is a cross-sectional view of the portion of the drilling system shown in FIG. 4, illustrating a core sample passing through the core lifter and the core lifter case.

With the core lifter 126 contacting and/or abutting the stop, portions of the core sample 128 may pass through the core lifter 126 as shown in FIG. 5, which may cause the core lifter 126 to resiliently deform and/or expand. As portions of the core sample 128 pass through the core lifter 126, friction between the core lifter 126 and the core sample may cause the core lifter 126 to continue to contact and/or abut the stop. After the core sample 128 is collected within the inner tube assembly 116, the inner tube assembly 116 may be unlocked from the outer tube 112, and the inner tube assembly 116 may be retrieved by a retrieval system. A trailing portion of the head assembly 124 of the inner tube assembly 116 may be connected to the retrieval system.

To facilitate core sample retrieval, a portion of the drill string 104 may be pulled, lifted and/or withdrawn out of the borehole. This may cause one or more portions of the core sample 128 to pass back through the core lifter 126 and/or exit the leading portion of the core lifter case 120. Friction between these portions of the core sample 128 and the core lifter 126 may cause the core lifter 126 and the core lifter case 120 to move relative to each other, which may cause the core lifter 126 to grip the core sample 128. This gripping of the core sample 128 and/or the pulling of the drill string 104 may break the core sample 128 off from the formation 102. It will be appreciated, however, that the core sample 128 may be broken off from the formation 102 using any other suitable means. After the core sample 128 is broken off from the formation, the inner tube assembly 116 and the core sample 128 may then be retrieved by the retrieval system as discussed above, while the drill bit 106, the outer tube 112, one or more of the drill rods 108 and/or other portions of the drill string 104 remain within the borehole.

Figure 6:
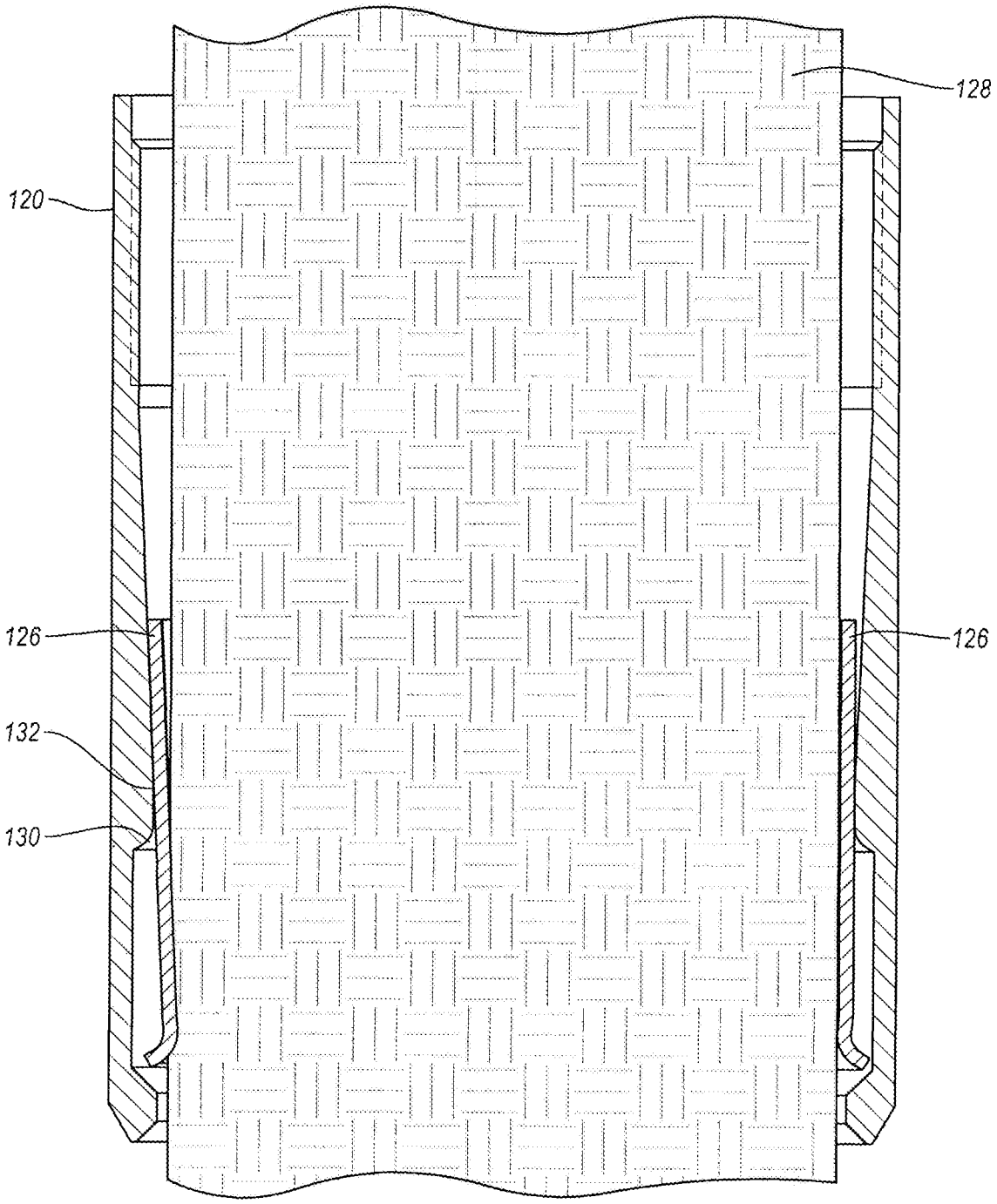
FIG. 6 is a cross-sectional view of the portion of the drilling system shown in FIG. 5, illustrating the core lifter gripping the core sample.

When the portion of the drill string 104 is pulled, lifted and/or withdrawn out of the borehole, the core lifter 126 may move from a first longitudinal position within the core lifter case 120, such as shown in FIG. 5, to a second longitudinal position within the core lifter case 120, such as shown in FIG. 6. As shown in FIGS. 5 and 6, a central axis of the core lifter 126 and a central axis of the core lifter case 120 may be aligned when the core lifter 126 is in the first longitudinal position, the second longitudinal position or both, but this is not required.

Figure 7:
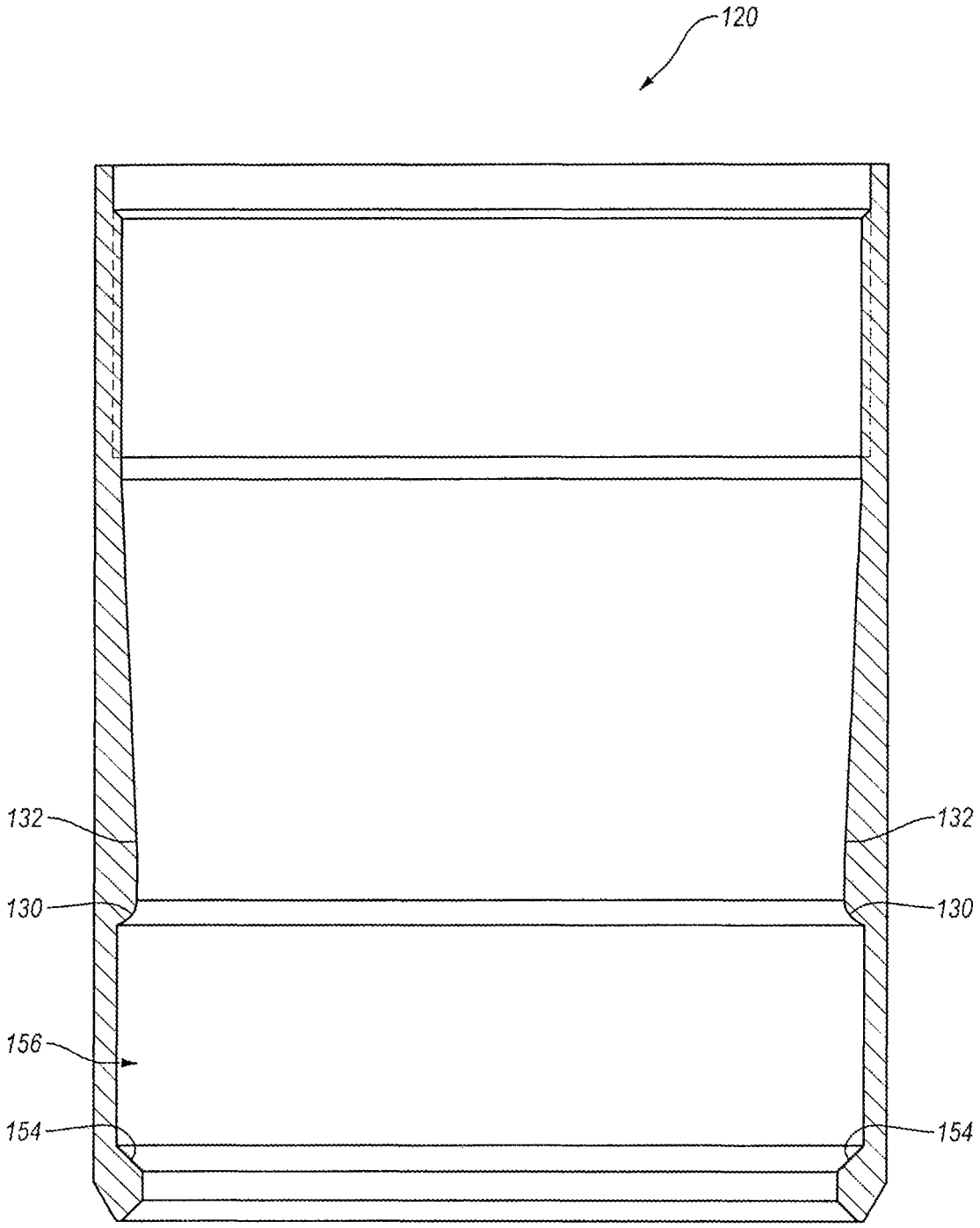
FIG. 7 is a cross-sectional view of the core lifter case shown in FIG. 4.
Figure 8:
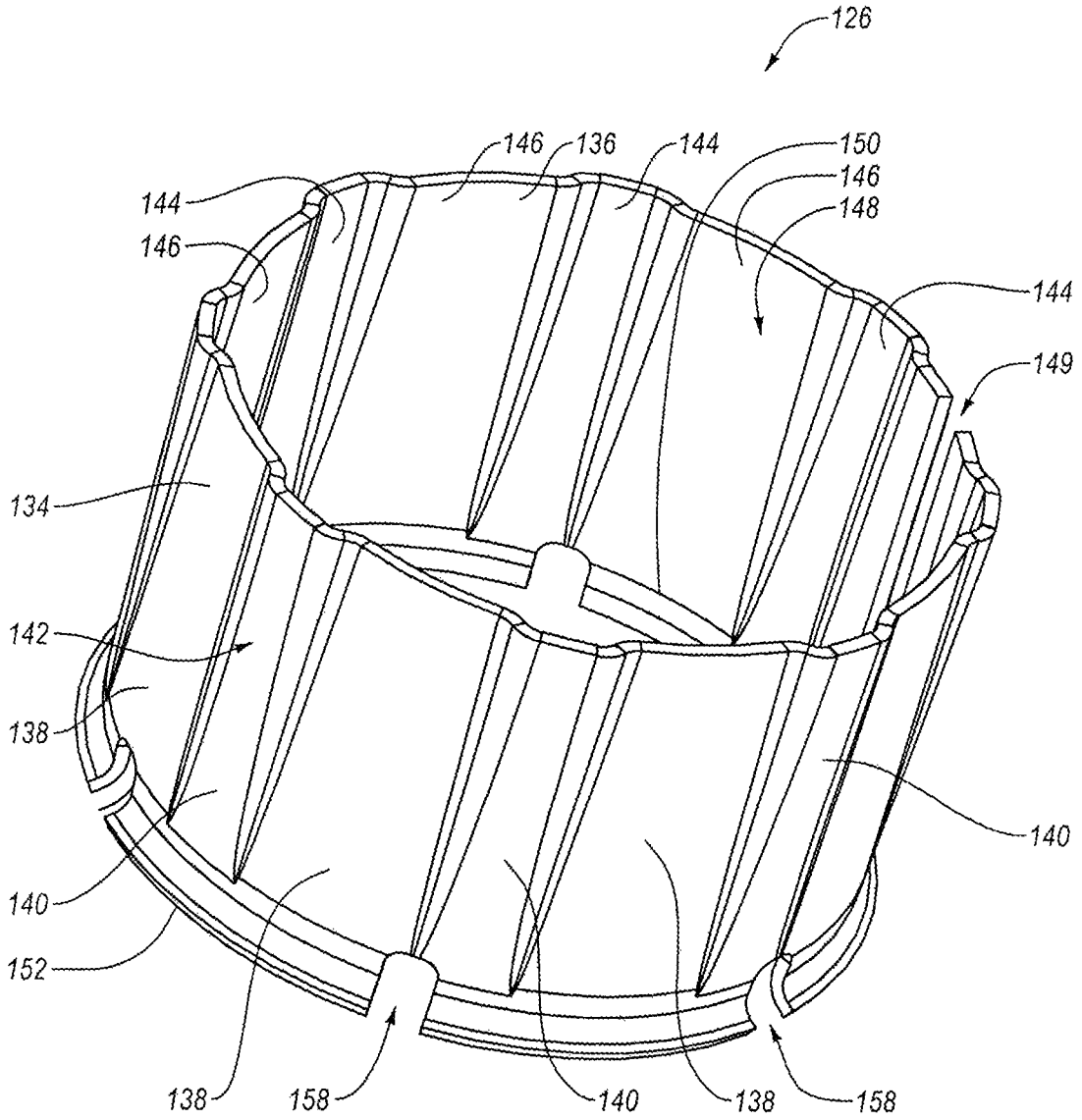
FIG. 8 is a perspective view of the core lifter shown in FIG. 4.
Figure 9:
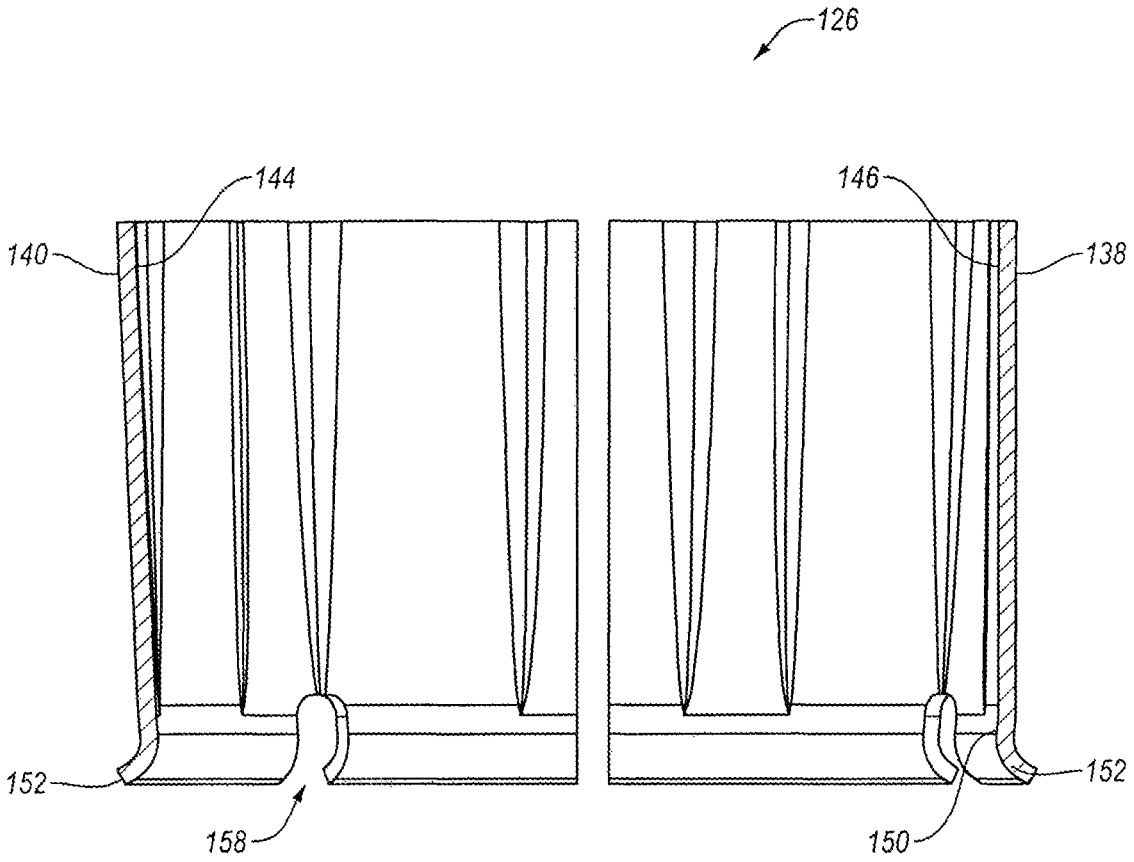
FIG. 9 is a cross-sectional view of the core lifter shown in FIG. 8.

When the core lifter 126 is in the second longitudinal position, an interior portion of the core lifter case 120 may compress the core lifter 126, which may contact, grip and/or break off the core sample 128. For example, the core lifter case 120 may comprise a tapered inner wall 132 shown in FIG. 7 that may compress the core lifter 126 as the core lifter 126 moves from a first longitudinal position to a second longitudinal position within the core lifter case 120. As shown in FIGS. 8 and 9, the core lifter 126 may comprise an exterior surface 134 and an interior surface 136. As the core lifter 126 moves from the first longitudinal position shown in FIG. 5 to the second longitudinal position shown in FIG. 6, the tapered inner wall 132 of the core lifter case 120 may contact and/or exert a force against one or more portions of the exterior surface 134 of the core lifter 126, which may compress the core lifter 126. For instance, the exterior surface 134 of the core lifter 126 may comprise one or more recesses 138 (such as flutes) and/or one or more projections 140, and the tapered inner wall 132 of the core lifter case 120 may contact and/or exert a force against a contact surface 142 that may be at least partially formed by the one or more projections 140, which may compress the core lifter 126. This compression may cause one or more portions of the interior surface 136 of the core lifter 126 to contact, grip and/or break off the core sample 128. For instance, the interior surface 136 of the core lifter 126 may comprise one or more recesses 144 (such as flutes) and/or one or more projections 146, and the compression of the core lifter 126 may cause a gripping surface 148 that may be at least partially formed by the one or more projections 146 to contact, grip and/or break off the core sample 128. If desired, the recesses 138, the projections 140, the recesses 144 and/or the projections 146 may be longitudinally-oriented, may be tapered and/or may extend along at least 50 percent, 60 percent, 70 percent, 80 percent, 90 percent and/or more of the length of the core lifter 126. It will be appreciated, however, that the recesses 138, the projections 140, the recesses 144 and/or the projections 146 may have other suitable sizes, shapes and/or configurations.

As shown in FIG. 8, the recesses 138 of the core lifter's exterior surface 134 may extend away from the contact surface 142 of the core lifter's exterior surface 134. Consequently, when the core lifter 126 moves between the first and second longitudinal positions within the core lifter case 120, the core lifter case 120 may contact and/or exert a force against the contact surface 142, but not the recesses 138, which may advantageously reduce the friction between the core lifter case 120 and the core lifter 126. This may advantageously reduce the amount of force used to pull, lift and/or withdraw the portion of the drill string 104, which may move the core lifter 126 from the first longitudinal position to the second longitudinal position. In addition, this may reduce wear and tear on the core lifter 126, thus extending the lifespan of the core lifter 126. In some embodiments, the contact surface 142 may be 90 percent, 80 percent, 70 percent, 60 percent, 50 percent, 40 percent and/or less of the surface area of the core lifter's exterior surface 134.

As shown in FIG. 8, the recesses 144 of the core lifter's interior surface 136 may extend away from the core lifter's gripping surface 148 of the core lifter's interior surface 136. In some embodiments, when portions of the core sample 128 are passing through the core lifter 126 during collection of the core sample 128, the core sample 128 may contact and/or exert a force against the core lifter's gripping surface 148, but not the recesses 144, which may advantageously reduce the friction between the core sample 128 and the core lifter 126. This may reduce wear and tear on the core lifter 126, thus extending the lifespan of the core lifter 126. In some embodiments, the gripping surface 148 may be 90 percent, 80 percent, 70 percent, 60 percent, 50 percent, 40 percent and/or less of the surface area of the core lifter's interior surface 136.

Desirably, the recesses 138, 144 and the projections 140, 146 may facilitate resilient compression and/or expansion of the core lifter 126. For example, the recesses 138, 144 and the projections 140, 146 may facilitate compression of the core lifter 126 when the tapered inner wall 132 of the core lifter case 120 contacts and/or exerts a force against the core lifter 126. Also, for example, the recesses 138, 144 and projections 140, 146 may facilitate resilient expansion of the core lifter 126 when portions of the core sample 128 are passing through the core lifter 126 during collection of the core sample 128. This may be particularly advantageous for collecting an irregularly shaped or unconsolidated core sample.

As shown in FIG. 8, the core lifter's exterior surface 134 may comprise a plurality of spaced apart recesses 138, and the core lifter's interior surface 136 may comprise a plurality of spaced apart recesses 144. This may form a corrugated configuration of the core lifter 126. For example, the core lifter's exterior surface 134 may comprise a plurality of alternating recesses 138 and projections 140, and the core lifter's interior surface 136 may comprise a plurality of alternating recesses 144 and projections 146. It will be appreciated, however, that the core lifter 126 does not require a corrugated configuration and that the recesses 138, 144 and the projections 140, 146 may be arranged in other suitable arrangements. It will also be appreciated that the core lifter's exterior surface 134 does not require any recesses 138 or any projections 140 and that the core lifter's interior surface 136 does not require any recesses 144 or any projections 146.

As shown in FIG. 8, the core lifter 126 may comprise a tubular body, which may comprise the exterior surface 134, the interior surface 136, the recesses 138, 144, the projections 140, 146, the contact surface 142 and/or the gripping surface 148. In addition, the tubular body of the core lifter 126 may comprise an elongated slot 149 that may extend along all or at least a substantial portion of the core lifter's length, which may facilitate resilient compression and/or expansion of the core lifter 126. The tubular body may have a taper along all or at least some of its length. It will be appreciated, however, that the core lifter 126 may have a variety of other suitable shapes, configurations and/or components.

Figure 10:
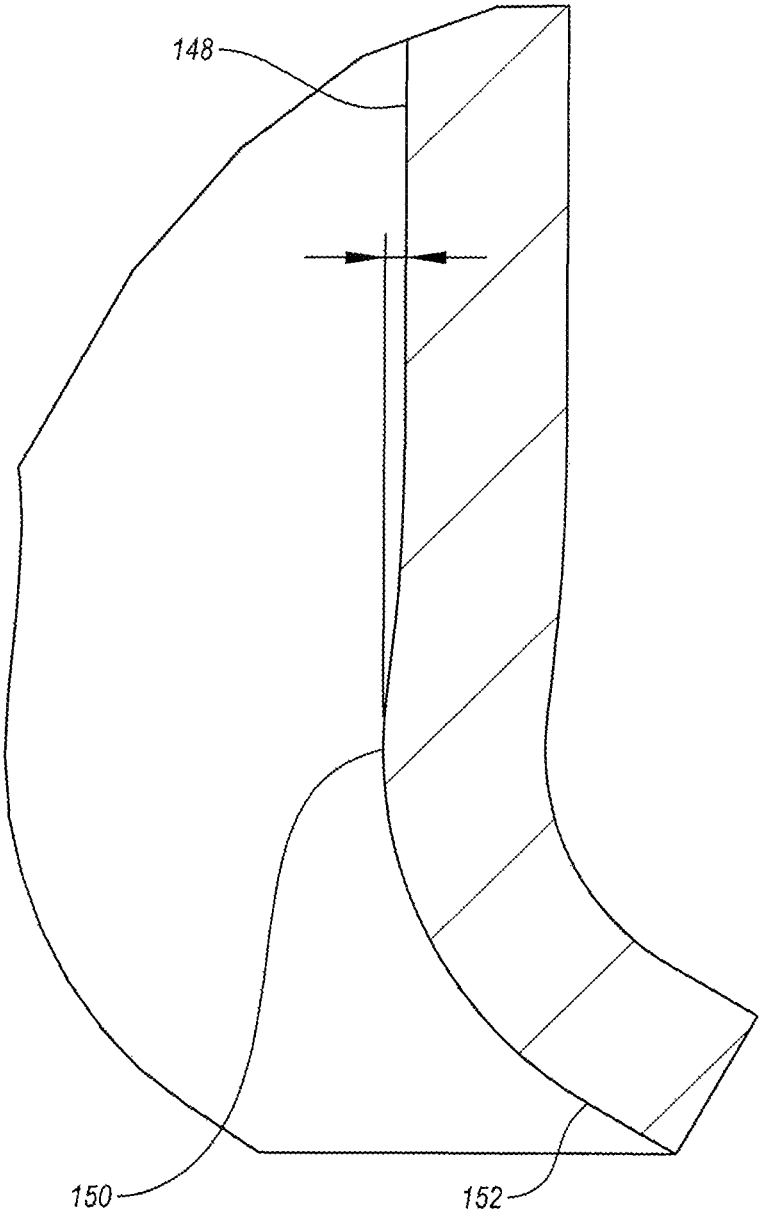
FIG. 10 is an enlarged cross-sectional view of a portion of the core lifter shown in FIG. 9.

As shown in FIGS. 9 and 10, the core lifter 126 may comprise a raised contact feature 150 that may extend inwardly away from the core lifter's gripping surface 148. The raised contact feature 150 may, for example, extend radially inwardly from the core lifter's gripping surface 148. In addition, the raised contact feature 150 may have a smaller inner diameter than an inner diameter of the core lifter's gripping surface 148. Consequently, the portions of the core sample 128 that pass through the core lifter 126 during collection as shown in FIG. 5 may primarily and/or exclusively contact the reduced inner diameter of the raised contact feature 150, which may create a slight interference fit. Moreover, the gripping surface 148 may be generally spaced apart from the portions of the core sample 128 as they pass through the core lifter 126 during collection. This may advantageously reduce wear and tear on the gripping surface 148, which may increase the lifespan of the gripping surface 148 relative to the raised contact feature 150. Thus, even if the raised contact feature 150 becomes worn or damaged, the gripping surface 148 may have less wear and may be advantageously able to contact, grip and/or break off the core sample 128 to facilitate core sample retrieval. Of course, although the raised contact feature 150 may primarily and/or exclusively contact the core sample 128 during collection, both the raised contact feature 150 and the gripping surface 148 may contact the core sample 128 when retrieving the core sample 128 as discussed above.

As shown in FIG. 10, the raised contact feature 150 may have a generally rounded shape. In addition, the raised contact feature 150 may form or be disposed at least proximate to a leading edge of the core lifter 126. The raised contact feature 150, however, may have any other suitable shape or configuration. In addition, the raised contact feature 150 may form or be disposed at least proximate to a leading edge of the core lifter 126, a trailing edge of the core lifter 126 and/or in any other suitable location. It will be appreciated that the core lifter 126 does not require any raised contact feature 150.

As shown in FIGS. 8-10, the core lifter 126 may comprise a flared skirt 152, which may form or be disposed at least proximate to a leading edge of the core lifter 126. Consequently, the raised contact feature 150 may be disposed between the flared skirt 152 and the gripping surface 148. The flared skirt 152 may form or be disposed at least proximate to a leading edge of the core lifter 126, a trailing edge of the core lifter 126, or any other suitable portion of the core lifter 126.

The flared skirt 152 may extend outwardly from the raised contact feature 150. The flared skirt 152 may, for example, extend radially outwardly from the raised contact feature 150. The flared skirt 152 may also extend beyond the contact surface 142 of the core lifter's exterior surface 134. The flared skirt 152 may be disposed adjacent and/or at least proximate to the raised contact feature 150.

The flared skirt 152 may contact a stop to limit the longitudinal movement of the core lifter 126 relative to the core lifter case 120. For example, the flared skirt 152 may be configured to contact the shoulder 130 of the core lifter case 120 as portions of the core sample 128 pass through the core lifter 126, as discussed above. Also, for example, the flared skirt 152 may be configured to contact a shoulder 154 shown in FIG. 7 integrally formed in an interior of the core lifter case 120. For instance, the flared skirt 152 may, when the portion of the drill string 104 is pulled, lifted and/or withdrawn out of the borehole to facilitate breaking the core sample 128 off the formation 102, the flared skirt 152 may contact the shoulder 154.

The flared skirt 152 may be at least partially disposed within and/or engage a recess 156 (such as a groove or other type of recess). The recess 156 may be integrally formed in an interior of the core lifter case 120 and may be at least partially defined by the shoulders 130, 154. The recess 156 may be disposed proximate the leading portion of the core lifter case 120. In addition, the recess 156 may be disposed in a relatively thicker portion of the core lifter case 120, which may advantageously allow the core lifter case 120 to be stronger. It will be appreciated, however, that the recess 156 may be disposed in other locations in the core lifter case 120. It will also be appreciated that the flared skirt 152, the recess 156 and the shoulders 130, 154 are not required.

If desired, other suitable stops may be used to limit the longitudinal movement of the core lifter 126 relative to the core lifter case 120. For example, the core lifter case 120 may comprise a recess (not shown) into which a stop ring (not shown) may be at least partially inserted. The stop ring may be used to limit the longitudinal movement of the core lifter 126 relative to the core lifter case 120 during collection of the core sample 128 and/or breaking off the core sample 128.

The flared skirt 152 may comprise one or slots 158. The slots 158 may facilitate resilient compression of the raised contact feature 150 and/or the flared skirt 152. For example, when the tapered inner wall 132 of the core lifter case 120 contacts and/or exerts a force against the core lifter 126 and a portion of the core sample 128 is disposed within the core lifter 126, the slots 158 may facilitate a flattening of the raised contact feature 150 and/or the flared skirt 152, which may help the gripping surface 148 to contact, grip and/or break off the core sample 128. To provide a desired amount of resilient compression of the raised contact feature 150 and/or the flared skirt 152, the slots 158 may have a variety of other sizes and shapes. For instance, depending on the desired amount of resilient compression, the slots 158 may be wider or narrower than as illustrated in the accompanying drawings. Moreover, depending on the desired amount of resilient compression, the flared skirt 152 may comprise more or fewer slots 158 than as illustrated in the accompanying drawings. It will be appreciated, however, that the flared skirt 152 does not require any slots 158 depending, for example, upon the particular configuration of the flared skirt 152.

Figure 11:
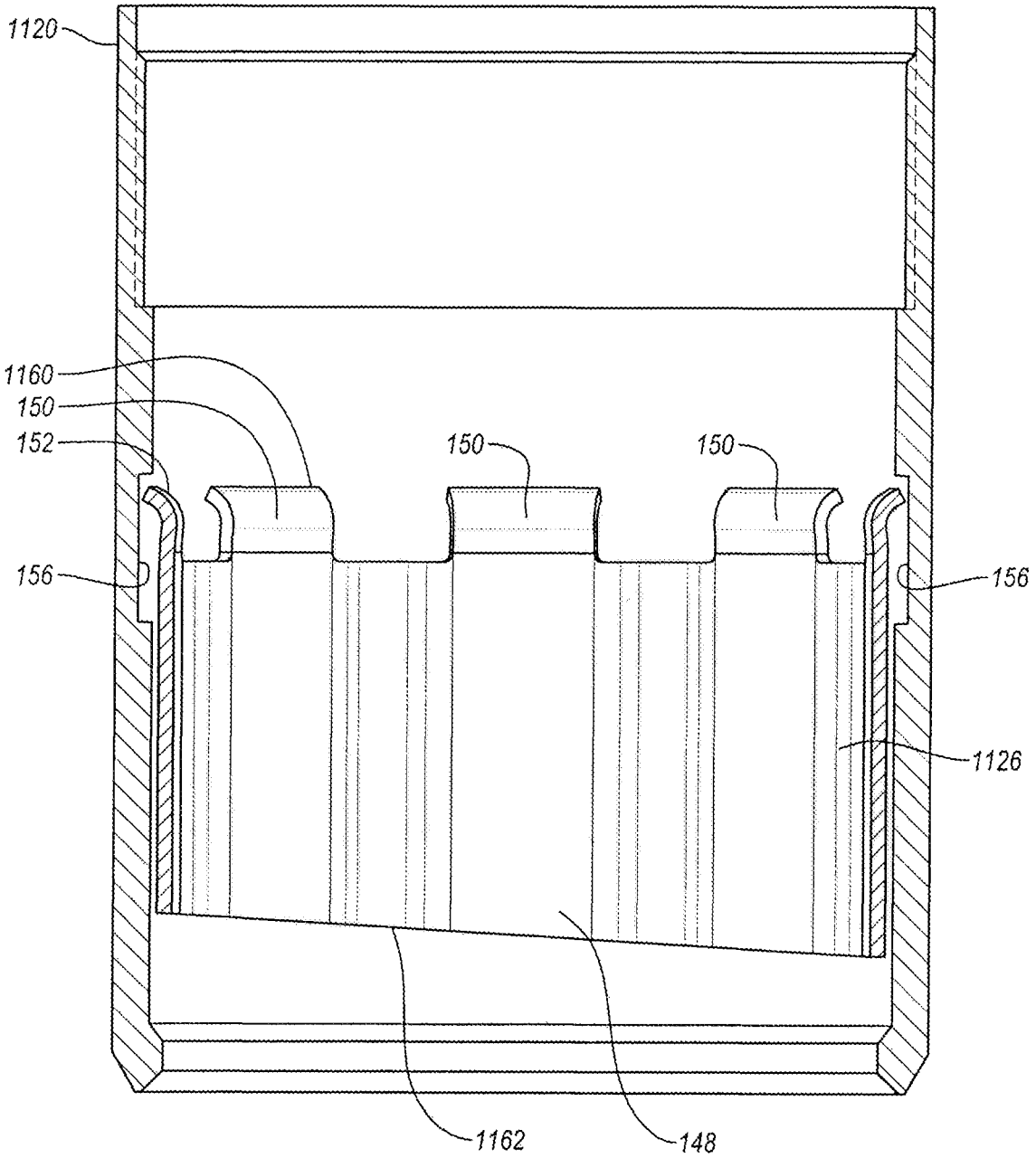
FIG. 11 is a cross-sectional view of an exemplary core lifter and an exemplary core lifter case.
Figure 12:
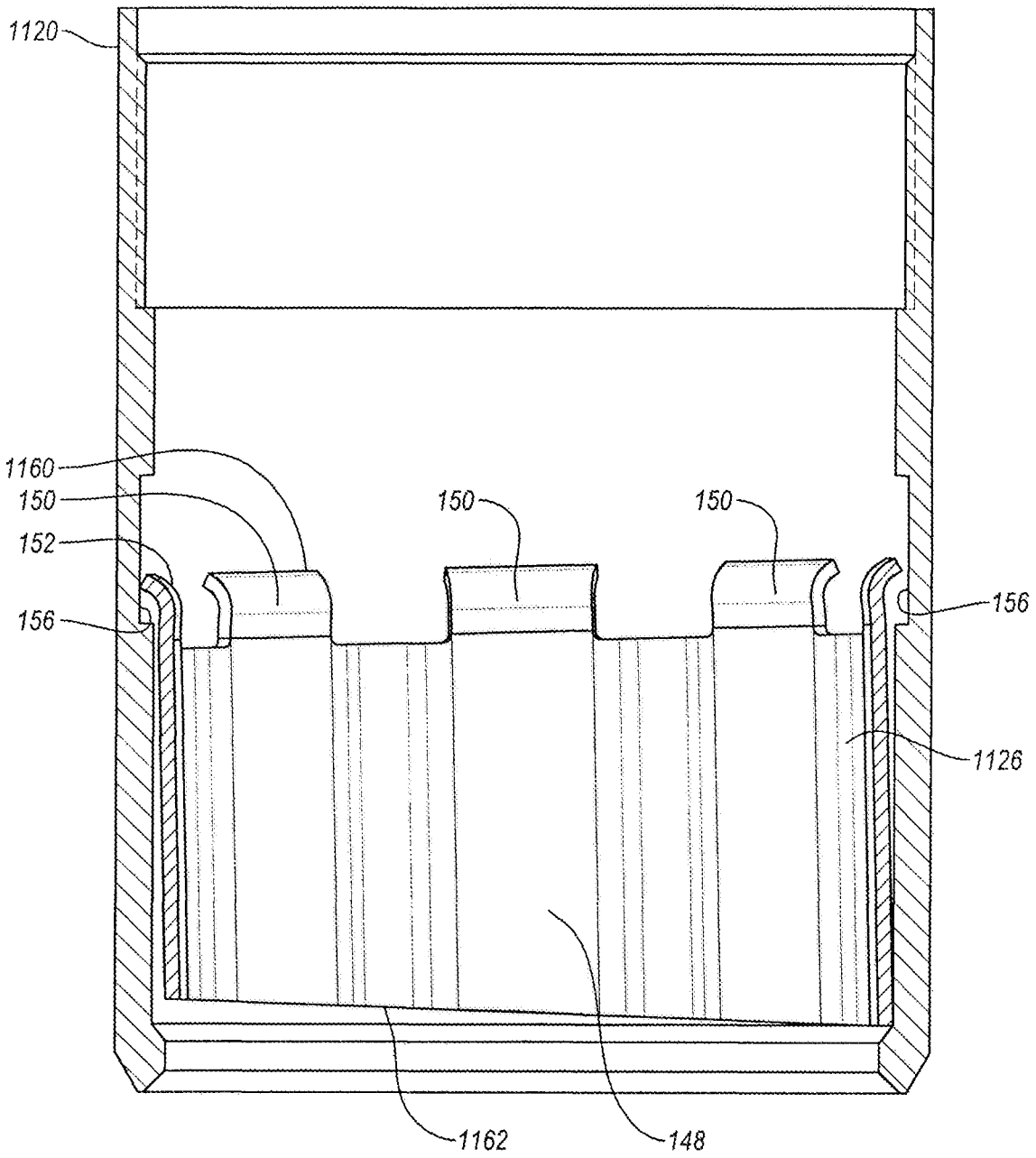
FIG. 12 is a cross-sectional view of an exemplary core lifter and an exemplary core lifter case, illustrating the core lifter and the core lifter case in another relative position.

A core lifter 1126 shown in FIGS. 11 and 12 may comprise any combination of the features and/or functionality of the core lifter 126 and other features and functionality. A core lifter case 1120 shown in FIGS. 11 and 12 may comprise any combination of the features and/or functionality of the core lifter case 120 and other features and functionality.

The core lifter 1126 may comprise a raised contact feature 150. The core lifter 1126 may also comprise a flared skirt 152. The flared skirt 152 of the core lifter 1126 may form or be disposed at least proximate to a trailing edge 1160 of the core lifter 1126 or any other suitable location. The flared skirt 152 of the core lifter 1126 may be at least partially disposed within and/or engage a recess 156 of the core lifter case 1120. It will be appreciated, however, that the raised contact feature 150 and the flared skirt 152 of the core lifter 1126 are not required.

With the inner tube assembly 116 locked to the outer tube 112 and with the drill bit 106, the core barrel assembly 110, the drill rods 108 and/or other portions of the drill string 104 being rotated and/or pushed into the formation 102, the inner tube assembly 116 may collect a core sample. For example, one or more portions of the core sample 128 may enter the core lifter case 1120, pass through the core lifter 1126, exit the core lifter case 1120, and enter the inner tube 118.

During this process, the core sample 128 may urge the core lifter 1126 longitudinally within the core lifter case 1120. For example, the core sample 128 may urge the core lifter 1126 longitudinally towards the trailing portion of the core lifter case 1120 (and away from the leading portion of the core lifter case 1120) until the core lifter 1126 contacts and/or abuts a stop, such as a shoulder integrally formed in an interior of the core lifter case 1120.

With the core lifter 1126 contacting and/or abutting the stop, portions of the core sample 128 may pass through the core lifter 1126, which may cause the core lifter 1126 to resiliently deform and/or expand. As portions of the core sample 128 pass through the core lifter 1126, friction between the core lifter 1126 and the core sample may cause the core lifter 1126 to continue to contact and/or abut the stop, for instance, as shown in FIG. 11. After the core sample 128 is collected within the inner tube assembly 116, the inner tube assembly 116 may be unlocked from the outer tube 112, and the inner tube assembly 116 may be retrieved by a retrieval system, as discussed above.

When a portion of the drill string 104 is pulled, lifted and/or withdrawn out of the borehole, as discussed above, the core lifter 1126 may move from a first longitudinal position within the core lifter case 1120, such as shown in FIG. 11, to a second longitudinal position within the core lifter case 1120, such as shown in FIG. 12. A central axis of the core lifter 1126 and a central axis of the core lifter case 1120 may be aligned when the core lifter 1126 is in the first longitudinal position. The central axis of the core lifter 1126 and the central axis of the core lifter case 1120 may be offset when the core lifter 1126 is in the second longitudinal position. When the central axes of the core lifter 1126 and the core lifter case 1120 are offset, the gripping surface 148 of the core lifter 1126 may grip the core sample 128 with a transverse force. This transverse gripping and/or the pulling of the drill string 104 may break the core sample 128 off from the formation 102.

If desired, the core lifter 1126 may comprise a leading edge 1162. The leading edge 1162 of the core lifter 1126 may be at an oblique angle relative to the central axis of the core lifter 1126, and the trailing edge 1160 of the core lifter 1126 may be at a perpendicular angle relative to the central axis of the core lifter 1126. This may help the central axes of the core lifter 1126 and the core lifter case 1120 to be offset when the core lifter 1126 is in the second longitudinal position. If desired, the leading edge 1162, the trailing edge 1160 or both may be at a perpendicular angle relative to the central axis of the core lifter 1126, be at an oblique angle relative to the central axis of the core lifter 1126, or any other suitable angle.

If desired, some or all of the features of the core lifters 126, 1126 may be formed using a stamping process. For example, some or all of the features of the core lifters 126, 1126 may be formed from a sheet of material using a stamping process. The material may comprise, for example, a metallic material, a heat-treated material, and/or other materials have other suitable characteristics. Exemplary features of the core lifters 126, 1126 that may be formed from a sheet of material and/or using a stamping process may comprise, but are not limited to, a tubular body of the core lifter, the exterior surface 134, the interior surface 136, the recesses 138, 144, the projections 140, 146, the contact surface 142, the gripping surface 148, the elongated slot 149, the raised contact feature 150, the flared skirt 152 the slots 158, or any combination thereof.

Desirably, the stamping process may reduce the cost of manufacturing the core lifters 126, 1126. Moreover, the stamping process may allow the core lifters 126, 1126 to be stronger and/or more durable. In addition, by using the stamping process with a sheet of material, the flexibility of the core lifters 126, 1126 may be accurately controlled by varying the thickness of the sheet of material. This differs from conventional core-lifter-manufacturing processes in which the flexibility of the core lifters can be difficult to accurately control. It will be appreciated, however, that the features of the core lifters 126, 1126 need not be formed using a stamping process, nor from a sheet of material and that the core lifters 126, 1126 may be formed using conventional or other manufacturing processes using other suitable components.

If desired, all or at least a portion of the core lifters 126, 1126 may be coated with anti-abrasion or wear-resistant coatings or treatments, such as a metal and micro-diamond composite coating bonded in an immersive electro-chemical process. In addition, case hardening heat treatments may be applied to the core lifters 126, 1126.

The methods and systems described above require no particular component or function. Thus, any described component or function—despite its advantages—is optional. Also, some or all of the described components and functions described above may be used in connection with any number of other suitable components and functions.

One skilled in the art will also appreciate that although the exemplary embodiments discussed above have been described with respect to drilling systems, these aspects and features may also be used in connection with many different processes.

Although this invention has been described in terms of certain preferred embodiments, other embodiments apparent to those of ordinary skill in the art are also within the scope of this invention. Accordingly, the scope of the invention is intended to be defined only by the claims which follow.

The invention claimed is:

1. A drilling system for collecting a core sample from a borehole, comprising:

a drill string;

an inner tube assembly configured for receipt within the drill string, the inner tube assembly comprising:

a core lifter, comprising:

a tubular body having an exterior surface and an interior surface;

a gripping surface defined by the interior surface of the tubular body of the core lifter, the gripping surface being configured to grip a core sample;

a plurality of longitudinally-oriented recesses formed in the exterior surface of the tubular body of the core lifter, the plurality of longitudinally-oriented recesses extending radially inwardly relative to the central axis, wherein the plurality of longitudinally oriented recesses do not extend radially through the tubular body between the exterior surface and the interior surface;

a plurality of tapered recesses formed in the interior surface of the tubular body of the core lifter, the plurality of tapered recesses extending radially outwardly and being tapered relative to the central axis, wherein the plurality of tapered recesses do not extend radially through the tubular body between the exterior surface and the interior surface;

a core lifter case configured to receive the core lifter, the core lifter case having a tapered inner wall, the tapered inner wall defining a shoulder configured for engagement with the core lifter; and an inner tube that is connected to the core lifter case, wherein the inner tube and the core lifter case are provided as a unitary, one-piece structure.

2. The drilling system of claim 1, wherein at least one of a leading edge or a trailing edge of the core lifter is at an oblique angle relative to a central axis of the core lifter.

3. The drilling system of claim 1, wherein at least one of a leading edge or a trailing edge of the core lifter is perpendicular to a central axis of the core lifter.

4. The drilling system of claim 1, wherein the core lifter further comprises a raised contact feature that extends inwardly away from the gripping surface.

5. The drilling system of claim 4, wherein at least one of a leading edge or a trailing edge of the core lifter is at an oblique angle relative to a central axis of the core lifter.

6. The drilling system of claim 4, wherein at least one of a leading edge or a trailing edge of the core lifter is perpendicular to a central axis of the core lifter.

7. The drilling system of claim 4, wherein the gripping surface has an inner diameter, and wherein the raised contact feature has an inner diameter that is smaller than the inner diameter of the gripping surface.

8. The drilling system of claim 4, wherein the raised contact feature has a generally rounded shape.

9. The drilling system of claim 4, wherein the core lifter further comprises one or more slots, and wherein, when portions of the core sample are passing through the core lifter, the one or more slots are configured to facilitate resilient compression of the raised contact feature of the core lifter.

10. The drilling system of claim 9, wherein the portions of the core sample that pass through the core lifter are configured to contact the raised contact feature of the core lifter, thereby creating an interference fit.

11. The drilling system of claim 10, wherein the gripping surface of the core lifter is spaced apart from the portions of the core sample that pass through the core lifter, thereby reducing wear on the gripping surface.

12. The drilling system of claim 9, wherein the gripping surface has an inner diameter, and wherein the raised contact feature has an inner diameter that is smaller than the inner diameter of the gripping surface.

13. The drilling system of claim 9, wherein the raised contact feature has a generally rounded shape.

14. The drilling system of claim 9, wherein at least one of a leading edge or a trailing edge of the core lifter is at an oblique angle relative to a central axis of the core lifter.

15. The drilling system of claim 9, wherein at least one of a leading edge or a trailing edge of the core lifter is perpendicular to a central axis of the core lifter.

* * * * *